US006076969A

United States Patent [19]

Jaisle et al.

[11] Patent Number: 6,076,969

[45] Date of Patent: Jun. 20, 2000

[54] RESEALABLE CLOSURE AND METHOD OF MAKING SAME

[75] Inventors: Richard Frederick Jaisle, Batesville, Ind.; Jeffrey Edwin Johnson, Fulton, N.Y.; Robert Charles Hebert, Lutherville, Md.

[73] Assignee: Sonoco Development, Inc., Hartsville, S.C.

[21] Appl. No.: 09/203,269

[22] Filed: Dec. 1, 1998

[51] Int. Cl.[7] ..... B65D 33/20

[52] U.S. Cl. ..... 383/211; 383/95

[58] Field of Search ..... 383/210, 211, 383/93, 95, 5

[56] References Cited

U.S. PATENT DOCUMENTS

| | | | |
|---|---|---|---|
| 3,272,422 | 9/1966 | Miller . | |
| 3,310,225 | 3/1967 | Hoblit et al. . | |
| 3,329,331 | 7/1967 | Morgan . | |
| 3,613,874 | 10/1971 | Miller . | |
| 3,827,625 | 8/1974 | Miller . | |
| 4,337,862 | 7/1982 | Suter . | |
| 4,389,270 | 6/1983 | McClintock | 156/218 |
| 4,415,087 | 11/1983 | Clayton et al. . | |
| 4,488,647 | 12/1984 | Davis | 383/210 X |
| 4,518,087 | 5/1985 | Goglio | 383/210 |
| 4,709,397 | 11/1987 | Voshall et al. | 383/5 |
| 4,937,040 | 6/1990 | Holcomb et al. | 383/211 X |
| 4,944,409 | 7/1990 | Busche et al. | 383/210 |
| 5,215,249 | 6/1993 | Gorrieri . | |
| 5,382,472 | 1/1995 | Yanidis et al. . | |
| 5,387,453 | 2/1995 | Cummisford | 428/77 |
| 5,413,815 | 5/1995 | Williams et al. . | |
| 5,527,112 | 6/1996 | Dais et al. . | |
| 5,564,834 | 10/1996 | Porchia et al. . | |
| 5,616,400 | 4/1997 | Zhang . | |

FOREIGN PATENT DOCUMENTS

| | | |
|---|---|---|
| 35 19 688 | 12/1986 | Germany . |
| WO 97/25200 | 7/1997 | WIPO . |

*Primary Examiner*—Jes F. Pascua
*Attorney, Agent, or Firm*—Alston & Bird LLP

[57] ABSTRACT

A flexible package for a product includes a resealable closure for resealing one portion of the package to an opposing portion of the package. The resealable closure is formed by applying a layer of pressure-sensitive adhesive on the inner surface of at least one of the opposing portions of the package, and applying a layer of cohesive to the inner surface of both of the opposing portions so that the pressure-sensitive adhesive layer is covered by a layer of cohesive. The pressure-sensitive adhesive has a greater affinity for adhering to the cohesive than to the inner surface of the package. Accordingly, pressure-sensitive adhesive is detached from the inner surface of the package when the opposing portions are pulled apart, and the portions can be resealed by pressing the portions back together to cause the pressure-sensitive adhesive to adhere to the portion from which is was detached.

7 Claims, 8 Drawing Sheets

110
112
9F
9F
OPEN
114

110
112
9D
9D
114

114
120
122
114

114
122
120
114
120

RESEALABLE CLOSURE AND METHOD OF MAKING SAME

FIELD OF THE INVENTION

The present invention relates to flexible product packages and, more particularly, to a flexible product package having a resealable closure.

BACKGROUND OF THE INVENTION

Product packagings having reclosure mechanisms are often employed for packaging products in situations where the consumer may wish to remove only a portion of the product and to reclose the package. Particularly with the current popularity of "fat-free" baked goods, which readily dry out if left exposed to atmosphere, there is a significant interest on the part of the product manufacturers in easily and inexpensively produced packaging which can be repeatedly opened and reclosed. Flexible packaging produced from flexible sheet materials are generally favored for reasons of cost, functionality, and marketing appeal.

Various types of reclosure mechanisms have been developed for reclosing a flexible package to keep unused portions of a food product fresh. Many of these mechanisms are separately manufactured articles which are added to the package either in a subsequent manufacturing step or by the consumer, such as zippers, reclosure tapes or tabs, seal strips, clips, and the like. However, such mechanisms are disadvantageous because they necessitate additional manufacturing operations and materials, thus increasing manufacturing cost. Accordingly, efforts have been made toward developing adhesive-based reclosure mechanisms for flexible packages, since such packaging is readily produced on automated flexible web-handling machinery, and the only component required is the flexible web to which adhesive has already been applied during the manufacturing process for the web.

The challenge in making a reclosure mechanism which relies on adhesive for resealing is that an adhesive which may be suitable for forming the original package seal, which must have sufficient strength and integrity to prevent inadvertent opening of the package and to keep the product fresh during handling and shipment, is generally different from the type of adhesive which is desirable from a resealing point of view. Cold seals, hot-melts, and heat seals provide good seal strength and are thus suitable for forming original package seals. Unfortunately, such materials do not generally provide sufficient reclosure capabilities. Pressure-sensitive adhesives can be repeatedly removed and reattached to suitable substrates and thus provide reclosure capabilities. However, pressure-sensitive adhesives do not provide sufficient closure strength to form reliable original package seals in many applications. Furthermore, because pressure-sensitive adhesives are inherently tacky and will stick to almost any surface they come in contact with, automated handling of sheets or webs to which pressure-sensitive adhesives have been applied is difficult. For example, the pressure-sensitive adhesive may become stuck to the rollers of an apparatus, a problem known in the industry as "picking." Additionally, the web may stick to itself when it is wound into a roll and stored prior to being used, a problem known as "blocking."

Accordingly, pressure-sensitive adhesives are commonly used in conjunction with backing layers of paper or other material to which a release coating has been applied, as shown in U.S. Pat. No. 3,827,625. When it is desired to operate a seal employing such a pressure-sensitive adhesive mechanism, the backing layer is removed to expose the pressure-sensitive adhesive, and the pressure-sensitive adhesive is pressed against a cooperating part of the package to effect a closure, whether an original seal or a reclosure of a previously opened seal. Alternatively, the backing layer is permanently attached to the cooperating part of the package to effect an original seal, and the substrate which carries the pressure-sensitive adhesive is peeled from the backing layer to open the original seal, as shown in U.S. Pat. No. 3,272,422. In either case, reclosure is effected by pressing the pressure-sensitive adhesive against the cooperating part or the backing layer.

The disadvantages of such closure mechanisms are that additional material and manufacturing operations are required to form the backing layer, and the strength of the original seal is only as good as the strength of the pressure-sensitive adhesive, which as previously noted is insufficient in many cases.

SUMMARY OF THE INVENTION

The invention overcomes the drawbacks of prior closures noted above by providing a product package having a resealable closure employing both a "cohesive" such as heat seal or cold seal for good original seal strength, and a pressure-sensitive adhesive for reseal capability, in which the pressure-sensitive adhesive does not interfere with automated handling of the packaging material, and no backing layers are required for the pressure-sensitive adhesive.

To these ends, the package of the invention comprises a generally flexible container having a flexible side wall and including an opening which is bounded by confronting edge portions of the side wall. The package has an openable and resealable seal along the opening. The seal is formed by placing first and second portions of the side wall inner surface adjacent the opening in confronting relation with each other and sealing them together by a seal composed of layers of pressure-sensitive adhesive and cohesive. A layer of pressure-sensitive adhesive is applied to at least the first portion of the inner surface, and a layer of cohesive is applied to the first and second portions of the inner surface so that the cohesive covers the layer of pressure-sensitive adhesive. The cohesive has good handling properties so that it does not readily stick to machinery which handles the packaging, and because the cohesive covers the pressure-sensitive adhesive, the inherent tackiness of the pressure-sensitive adhesive does not interfere with handling of the packaging during manufacturing.

The pressure-sensitive adhesive has a greater affinity for adhering to the cohesive than to the inner surface of the package. Thus, upon initial opening of the top seal, the cohesive layers on the first and second portions of the inner surface tend to remain adhered together, and the pressure-sensitive adhesive layer underlying the cohesive on the first portion tends to remain adhered to the overlying cohesive layer. Accordingly, regions of pressure-sensitive adhesive are detached from the first portion and remain with the cohesive layer on the second portion of the inner surface. Resealing of the seal is accomplished by placing the first and second portions of the inner surface in approximately their original sealed positions and pressing them together to cause the detached regions of pressure-sensitive adhesive to be reattached to the first portion of the inner surface.

The package preferably is formed of a generally rectangular flexible sheet having an inner surface which faces the product, two opposite longitudinal edges, and top and bottom transverse edges. The sheet is folded about longitudinally extending fold lines to form the generally tubular package having a portion of the inner surface adjacent one longitudinal edge sealed to a corresponding portion of the inner surface adjacent the other longitudinal edge to define a longitudinal seal. Similarly, top and bottom seals are produced by sealing the sheet to itself along the top and bottom edges.

One of the three seals is formed as a recloseable seal. In one preferred embodiment of the invention, the pressure-sensitive adhesive is applied in a pattern extending transversely along the top edge of the rectangular sheet, and cohesive is then applied along the top edge so as to cover the pressure-sensitive adhesive. Thus, when the original top seal is formed by crimping the top edge portions together (and also applying heat if the cohesive is a heat seal), a cohesive-to-cohesive bond is formed between the layers of cohesive on the confronting portions of the top edge.

In an alternative preferred embodiment of the invention, the recloseable seal is formed along the longitudinal seal, in the same manner as described above for the top seal.

Because the original strength of the recloseable seal is only as good as the strength of the pressure-sensitive adhesive, the recloseable seal preferably is augmented by a strip of cohesive applied to a portion of the inner surface which is not covered by the pressure-sensitive adhesive and which extends along substantially the entire edge of the sheet. The strip of cohesive enhances the strength of the original top seal by adhering to itself without the interposition of any pressure-sensitive adhesive between the cohesive and the sheet.

The strip of cohesive advantageously is located between the top edge of the sheet and the pressure-sensitive adhesive layer so that the strip of cohesive forms the outermost part of the top seal and prevents the pressure-sensitive adhesive layer from being detached from the inner surface until the top seal is fully opened.

To reduce the tendency of the cohesive to form long strings of adhesive upon opening of the seal, which can contaminate the pressure-sensitive adhesive and reduce its tackiness and thus the reclose performance of the top seal, the strip of cohesive may be applied in a discontinuous pattern, such as a series of circular dots spaced apart along the width of the top edge of the sheet. Alternatively or additionally, the strip of cohesive may be printed in a screen pattern having substantially less than 100 percent coverage of the inner surface by the cohesive, and preferably about 50 percent coverage.

The substrate or web that forms the package preferably is laminated from several layers of different materials each imparting a desired property to the laminate. For example, in accordance with one preferred embodiment of the invention, the laminate comprises an outer layer of polyethylene teraphthalate (PET), a middle layer of high-density polyethylene (HDPE), and a 60-gauge inner layer of a metallized cold seal release oriented polypropylene. The PET layer is readily printed with commonly used inks for placing graphics and indicia on the package. The cold seal release layer facilitates detachment of the pressure-sensitive adhesive from the substrate, so that higher-tack adhesives can be used, and the metallizing of the release layer provides a moisture-barrier function. The HDPE layer provides additional tear strength to the laminate.

In an alternative preferred embodiment of the invention, the laminate comprises an outer PET layer and a 75-gauge inner layer of metallized cold seal release. By thickening the release layer, the HDPE layer can be eliminated.

BRIEF DESCRIPTION OF THE DRAWINGS

Additional objects, features, and advantages of the invention will become apparent from the following detailed description of particular embodiments thereof, taken in conjunction with the accompanying drawings in which.

DETAILED DESCRIPTION OF THE DRAWINGS

Figure 1:
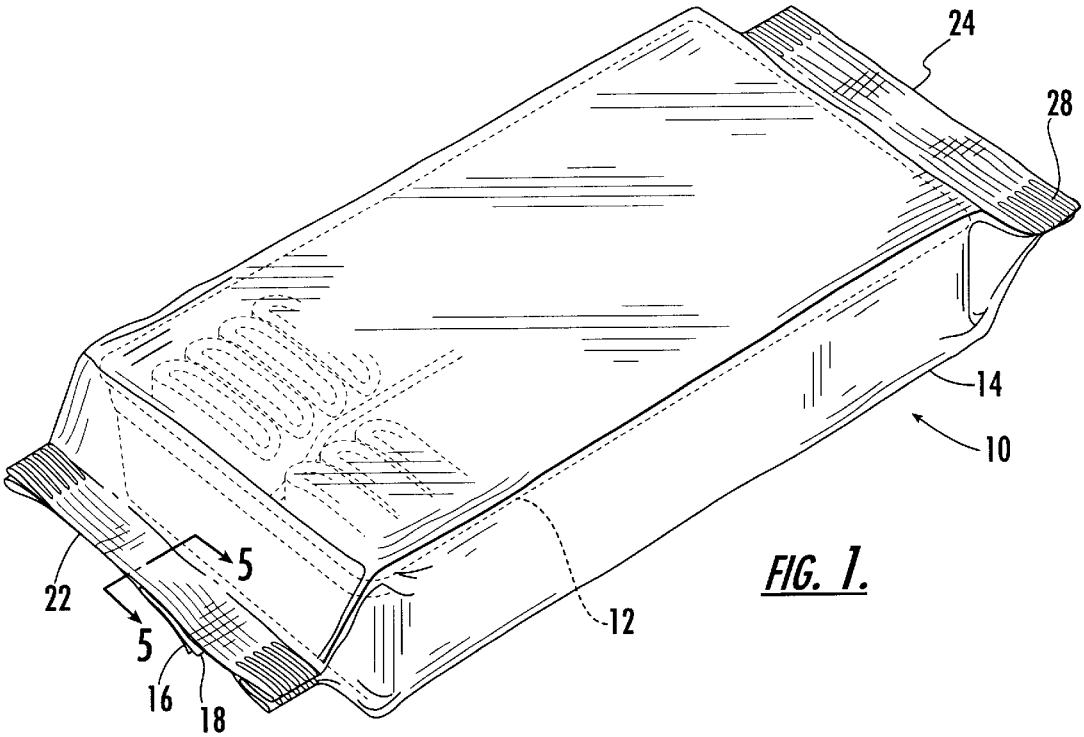
FIG. 1 is a perspective view of a package including a product package in accordance with the present invention, with the package in a closed condition as initially sealed during a packaging operation.

With reference to FIG. 1, a package is broadly designated by reference numeral 10. The package 10 includes a product 12 enclosed by a flexible package 14. The package 14 is formed of a flexible film material. For packaging food products which are adversely affected by changes in moisture content caused either by evaporation of moisture from the product or contact of the product by external moisture, the package 14 preferably is made of a film which acts as a moisture barrier. Suitable materials include polyethylene, lowdensity polyethylene (LDPE), high-density polyethylene (HDPE), polyethylene teraphthalate (PET), oriented polypropylene (OPP), metallized OPP, PVDC-coated OPP, polyamide, and others.

The package 14 is generally in the form of a tubular container formed of a generally rectangular sheet which has its opposite longitudinal edges 16 and 18 sealed together to form a longitudinally extending seal 20 along the length of the package 10. Alternatively, the package may be formed from film which has been extruded into a tubular form, so that there is no longitudinal seal 20. Preferably, however, the package is formed of film material in the form of a flat sheet, to facilitate printing designs and/or indicia on the outer surface of the package prior to enclosing the product and sealing the edges of the sheet. The transverse edges 22 and 24 are likewise sealed together along transverse seals 26 and 28, respectively, to close the two opposite ends of the tubular wrapper, thus enclosing and sealing the product 12 in the package 14.

Figure 2:
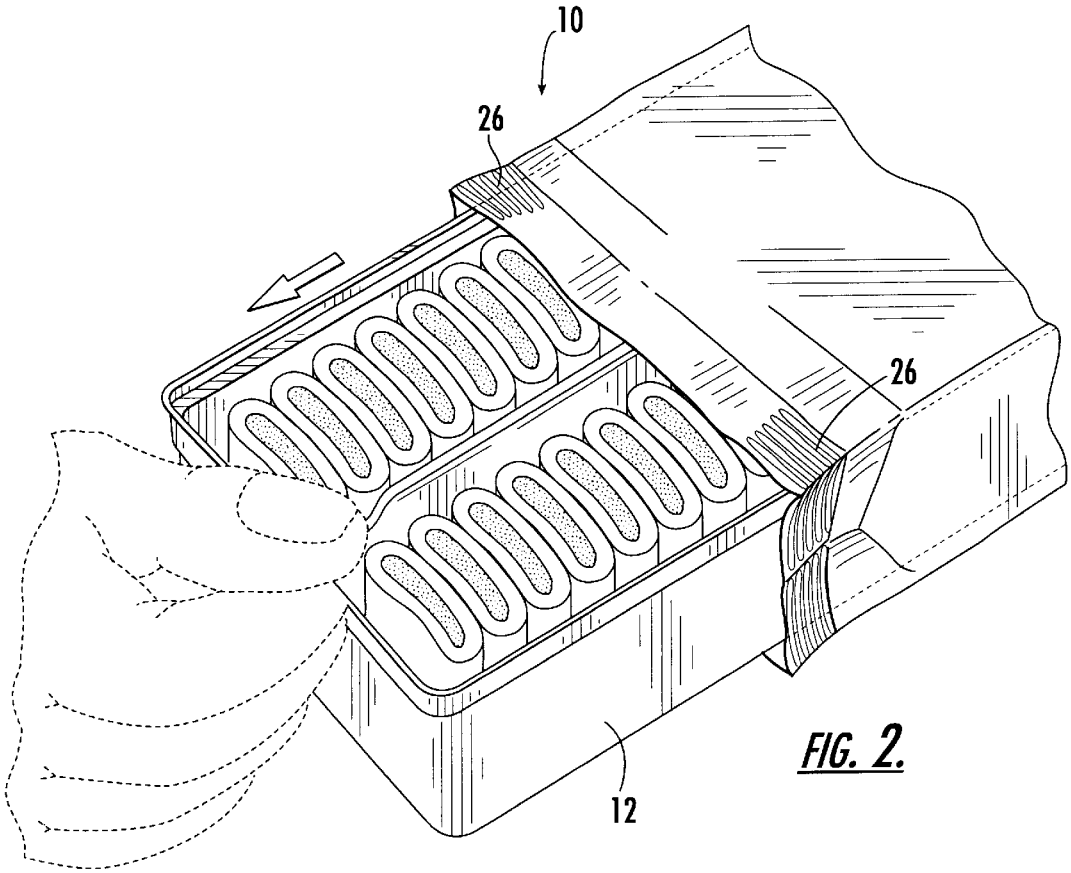
FIG. 2 is a fragmentary view similar to FIG. 1, showing one end of the package opened to form an opening for removal of product from the package.
Figure 1A:
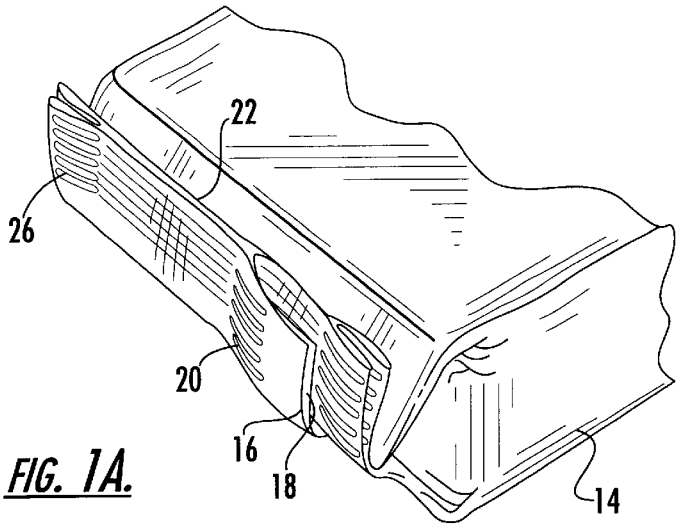

Either one of the end seals 26 or 28, or alternatively the longitudinal seal 20, may be formed as an openable and resealable seal. In the embodiment of the invention shown in FIGS. 1–6, the top seal 26 defines the resealable seal. FIG. 2 shows the seal 26 in an open condition with the opposing portions or side walls of the package 14 having been pulled apart to define an opening 30 through which product 12 may be removed or inserted.

Figure 3:
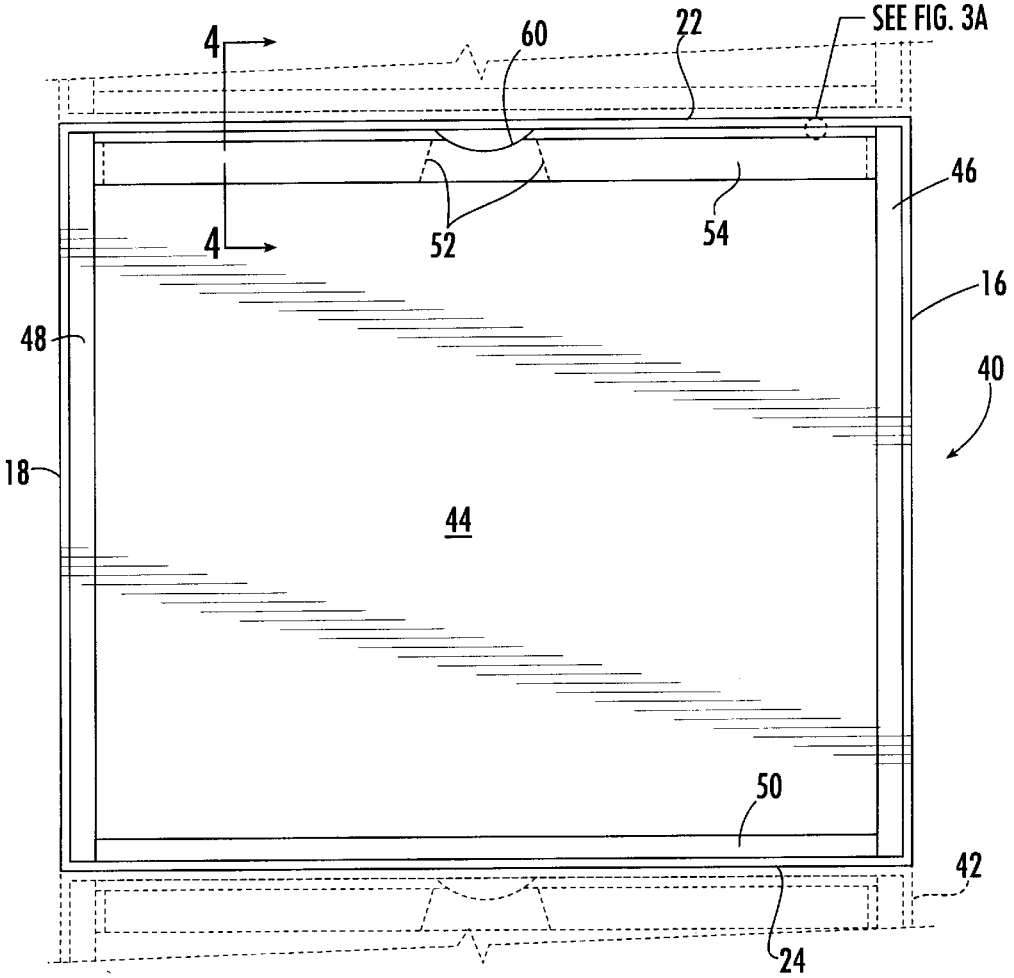
FIG. 3 is a top elevational view of a sheet for forming an package in accordance with the invention.

FIG. 3 depicts a top elevational view of a flexible sheet 40 for forming the package 14. The sheet 40 has opposite longitudinal edges 16, 18 and opposite transverse edges 22, 24. The sheet 40 may be cut from an elongated web 42 of film material, either before or after adhesives are applied to the sheet 40 for making the seals of the package 14, in which case the sheet 40 is formed by cutting the web 42 along two transverse cut lines to create the edges 22 and 24. The sheet 40 has a surface 44 which faces the product 12 upon formation of sheet 40 into the package 14. The product-facing surface 44 advantageously is made of a smooth, substantially nonporous material to which adhesives readily adhere without being significantly absorbed. As further described below, the product-facing surface 44 preferably is a metallized OPP or PVDC-coated OPP which acts as a release material for pressure-sensitive adhesive.

Longitudinal adhesive strips 46 and 48 are applied to the product-facing surface 44 adjacent the longitudinal edges 16 and 18, respectively, and a transverse adhesive strip 50 is applied adjacent the transverse edge 24. The adhesive strips 46, 48, and 50 preferably are formed of a cohesive which readily adheres to the product-facing surface 44 and to itself, and which will readily seal together overlying portions of packaging film to which the cohesive has been applied upon application of pressure with or without heat to the overlying portions by a sealing die or the like, as is well known in the packaging industry. Preferably, the cohesive comprises a cold seal adhesive which is sealed to itself by application of pressure alone.

Thus, as further described below, the longitudinal adhesive strips 46 and 48 are brought into contact with each other and sealed together to create the longitudinal seal 20, the sheet 40 thus forming a generally tubular configuration. Opposing portions of the sheet 40 adjacent the transverse edge 24 are brought together to place the transverse adhesive strip 50 on one of the opposing portions into contact with the strip 50 on the other portion and the portions are sealed together to create the transverse seal 28. The seal 28 is not intended to be opened and, if it does become opened, the cohesive does not provide resealing capabilities.

The opposite transverse seal 26 differs from transverse seal 28 in that the seal 26 is resealable after the initial opening thereof. To this end, the seal 26 is formed by the unique application of both cohesive and pressure-sensitive adhesive to the product-facing surface 44 adjacent the transverse edge 22. Thus, with reference to FIGS. 3 and 4, pressure-sensitive adhesive strips 52 are first applied to the product-facing surface 44 of sheet 40 along and adjacent the transverse edge 22, and then a cohesive strip 54 is applied over the pressure-sensitive adhesive strip 52. The cohesive preferably extends closer to the transverse edge 22 than do the pressure-sensitive adhesive strips 52, such that a cohesive strip 56 is applied to the surface 44 of sheet 40 without the interposition of pressure-sensitive adhesive therebetween. Upon formation of the transverse seal 26 along the edge 22, the cohesive strip 56 forms an outer portion of the seal 26 which has greater strength than the portion of the seal 26 formed by the cohesive strip 54 and pressure-sensitive adhesive strips 52, and also prevents operation of the resealable feature of seal 26 until the seal 26 has been fully opened.

By "cohesive" is meant an adhesive which when dry is substantially non-tacky such that it is not susceptible to substantial picking or blocking, and which readily adheres to itself upon application of pressure alone (such as cold seals) or upon application of pressure and heat (such as heat seals).

Figure 5:
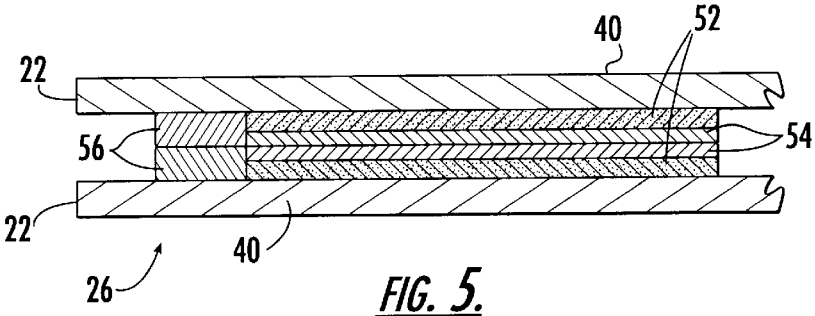
FIG. 5 is a cross-sectional view taken on line 5—5 of FIG. 1, showing the cooperating portions of the package sealed together to define an initial seal along the openable end of the package, with the cohesive layers sealed to each other.
Figure 6:
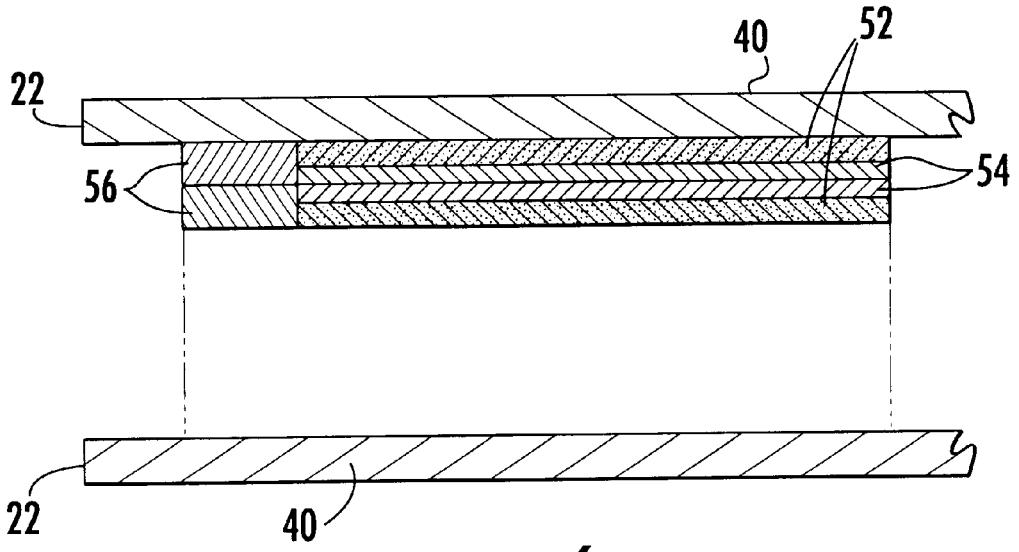
FIG. 6 is a cross-sectional view taken on line 6—6 of FIG. 2, showing the cooperating portions of the package after being pulled apart to open the initial seal along the openable end of the package, with the cohesive layers still adhered together and the pressure-sensitive adhesive underlying one of the cohesive layers having been detached from the package sheet to which it was originally applied.

The resealable feature of the seal 26 is provided by the layering of the cohesive 54 over the pressure-sensitive adhesive 52. As shown in FIG. 5, when the seal 26 is sealed and intact, the cohesive layers 54 and 56 on opposing portions of the sheet 40 contact and adhere to each other. The pressure-sensitive adhesive layers 52 adhere to the overlying cohesive layers 54 and also to the sheet 40. However, the pressure-sensitive adhesive and the inner surface 44 of the sheet 40 are selected such that the pressure-sensitive adhesive has a greater affinity for adhering to the cohesive 54 than to the sheet 40. Thus, as shown in FIG. 6, when the seal 26 is opened, the adhesive bond between the cohesive layers 54 and the pressure-sensitive adhesive 52 is stronger than that between the pressure-sensitive adhesive layers 52 and the sheet 40 and, accordingly, the pressure-sensitive adhesive 52 is detached from one or the other of the opposing portions of sheet 40. In practice, detachment of the pressure-sensitive adhesive does not necessarily occur uniformly, but may occur in regions of one portion of sheet 40 and other regions of the opposing portion of sheet 40. Nevertheless, as a result of opening the seal 26, there is exposed pressure-sensitive adhesive 52 on one or both of the opposing portions 40.

Resealing of the seal 26 is accomplished by placing the opposing portions of the sheet 40 approximately in their original sealed positions and pressing the opposing portions together to cause the pressure-sensitive adhesive 52 to adhere to the opposite portion of sheet 40, so that the seal 26 again assumes a condition similar to that shown in FIG. 5. It is not critical that the pressure-sensitive adhesive 52 be placed in exact registration with the region of the sheet 40 from which it was detached, since the pressure-sensitive adhesive 52 will readily adhere either to the sheet 40, to cohesive 54, or to another region of exposed pressure-sensitive adhesive 52.

The inner surface 44 of the sheet 40 preferably comprises a release material for the pressure-sensitive adhesive. Suitable release materials include OPP, metallized OPP, and PVDC-coated OPP. Using a release material allows the use of pressure-sensitive adhesives having relatively higher tack, which is advantageous for good reseal strength, while still enabling the pressure-sensitive adhesive to be readily detached from the substrate during opening.

Examples of suitable cohesives include the Nip-Weld C7089, C1099, 210, and 1293 cold seal adhesives available from ATO Findley Inc. of Wauwatosa, Wis. Examples of suitable pressure-sensitive adhesives include the C7088 pressure-sensitive adhesives available from ATO Findley.

Figure 3A:
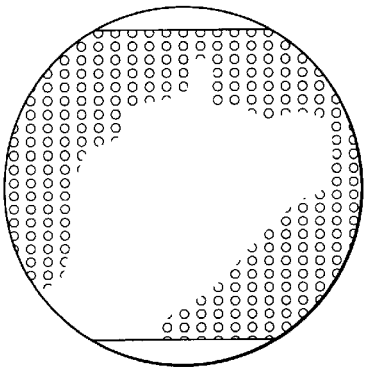
FIG. 3A is a magnified view of a portion of the screen-printed non-pressure-sensitive.

Cold seal adhesives have a tendency to "leg", i.e., to form strings when pulled apart. When cold seal adhesive is used for making the resealable seal 26, the legging tendency represents a problem in that the strings of cold seal adhesive can contaminate the exposed surfaces of pressure-sensitive adhesive and thereby impair reseal performance. In order to reduce this contamination problem, the cold seal adhesive strip 56 is advantageously applied in a screen print pattern so that substantially less than 100 percent of the surface 44 in the region of the strip 56 is covered by cold seal adhesive. Preferably, about 50 percent of the surface is covered by cold seal adhesive, as shown in FIG. 3A. Applying the cold seal adhesive in this manner substantially reduces the amount of legging of the cold seal adhesive.

Figure 3B:
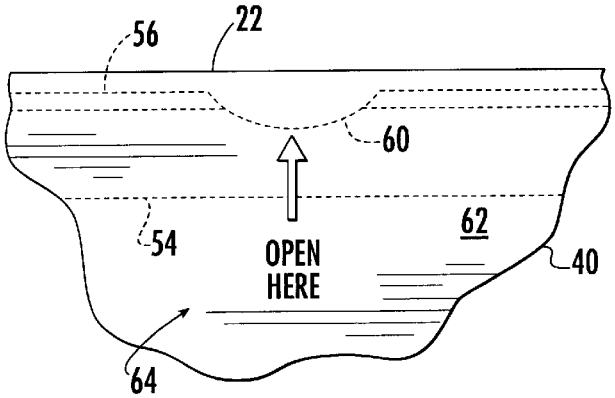
FIG. 3B is a fragmentary elevational view of the outer surface of the sheet of FIG. 3, showing indicia in conjunction with the thumb tab.
Figure 4:
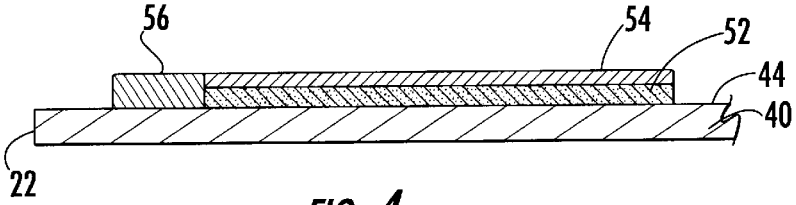
FIG. 4 is a cross-sectional view taken on line 4—4 of FIG. 3.

To facilitate opening of the seal 26, the package 14 preferably includes a thumb tab 60. The thumb tab 60 comprises a portion of the cohesive strip 56 which is interrupted and an adjacent portion of the cohesive strip 54 which is indented away from the edge 22 of the sheet 40, so that no adherence of the opposing portions of the sheet 40 takes place in the region defined by the interrupted and indented portions. As shown in FIG. 3B, the outer surface 62 of the sheet 40 advantageously is provided with indicia 64 for instructing a consumer how to use the thumb tab 60.

Figure 8:
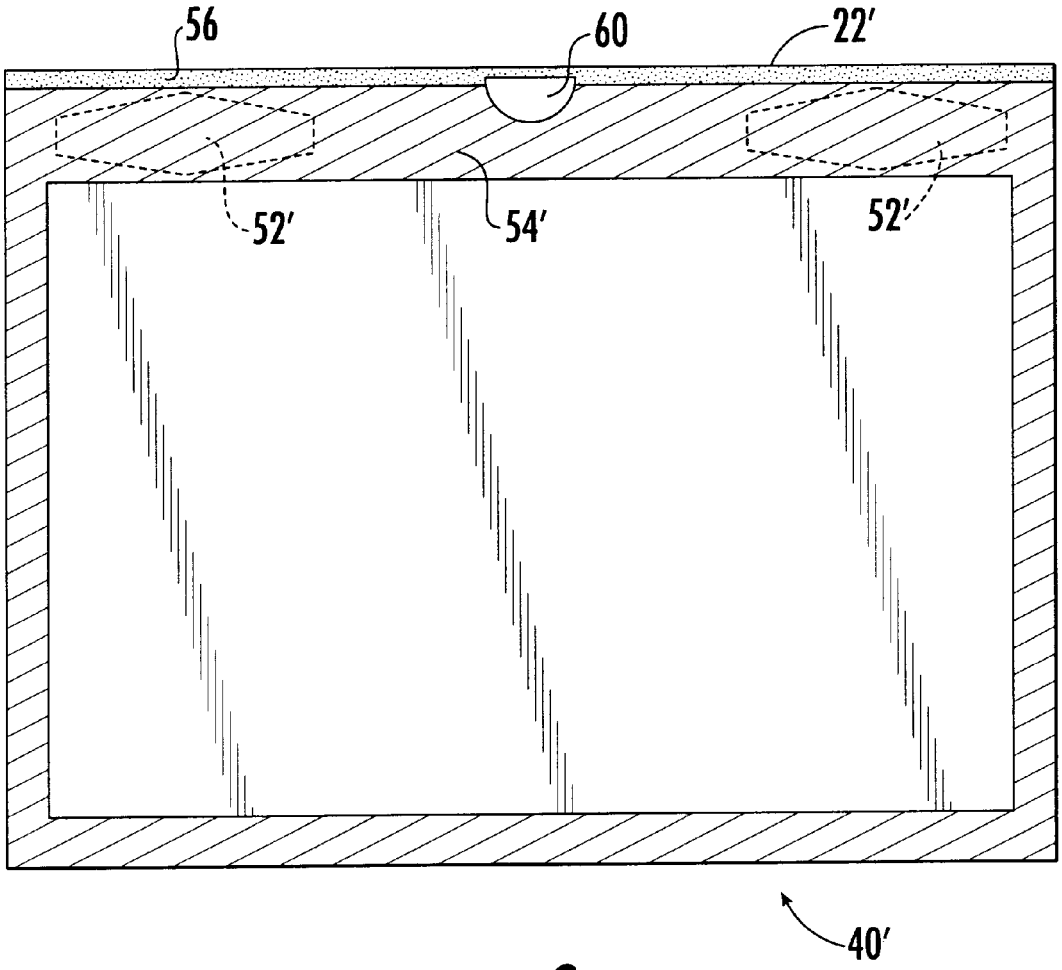
FIG. 8 is a view similar to FIG. 3, showing a sheet for forming another preferred embodiment of a package in accordance with the invention.

FIG. 8 is a view similar to FIG. 3, showing an alternative preferred embodiment of a sheet 40' for making a package in accordance with the invention. The sheet 40' differs from the sheet 40 in the application of the pressure-sensitive adhesive and the cohesive along the top edge 22' of the sheet. Specifically, the pressure-sensitive adhesive is applied in two discrete and separate strips 52' each of which has a chevron shape. The chevron-shaped strips 52' are located on opposite sides of a longitudinal centerline of the sheet 40'. A strip 54' of cohesive covers the strips 52' and extends across the full width of the sheet. A thumb-tab indent 60' is defined in the cohesive strip 54'. A continuous strip 56' of cohesive extends along the full width of the sheet between the top edge 22' and the strip 54'. The strip 56' is printed with a screen pattern having substantially less than 100 percent coverage, preferably about 50 percent coverage. The chevron configuration of the strips 52' facilitates detachment of the pressure-sensitive adhesive from the sheet 40' by promoting initial detachment at the vertices closest to the top edge 22', detachment then proceeding along the sloping edges of the chevron. Advantageously but not necessarily, the pressure-sensitive adhesive strips 52' are printed in a screen pattern having substantially less than 100 percent coverage.

As previously noted, the invention is not limited to packages having the openable and resealable seal at the end of the package. FIGS. 9A–F show a package 110 in accordance with an embodiment of the invention in which the openable and resealable seal 112 is a longitudinal seal extending along the length of the package. The seal 112 is constructed in a manner similar to that of the resealable seals of the packages 10 and 10' described above. The seal 112 may be formed by bringing together two opposite edge portions of a sheet 114 each having the pressure-sensitive adhesive/cohesive system, similar to the packages 10 and 10' described above. Alternatively, and as illustrated in FIGS. 9A–F, the seal 112 may be formed by folding a sheet 114 along a longitudinal fold line 116 so that two opposing portions of the sheet are brought together, each of the portions having the pressure-sensitive/cohesive system. In this case, opening of the package along the seal 112 is initiated the first time by cutting along the fold line as shown in FIG. 9A so that the opposing portions of the sheet can be pulled away from each other.

Figure 9B:
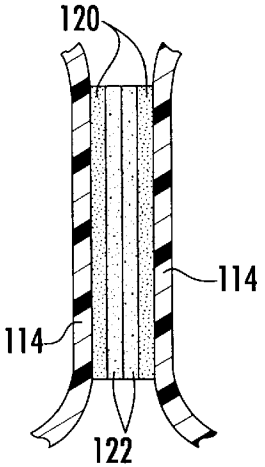
FIGS. 9A–F depict yet another preferred embodiment of a package in accordance with the invention, in which the resealable seal extends along the length of the package.
Figure 9A:
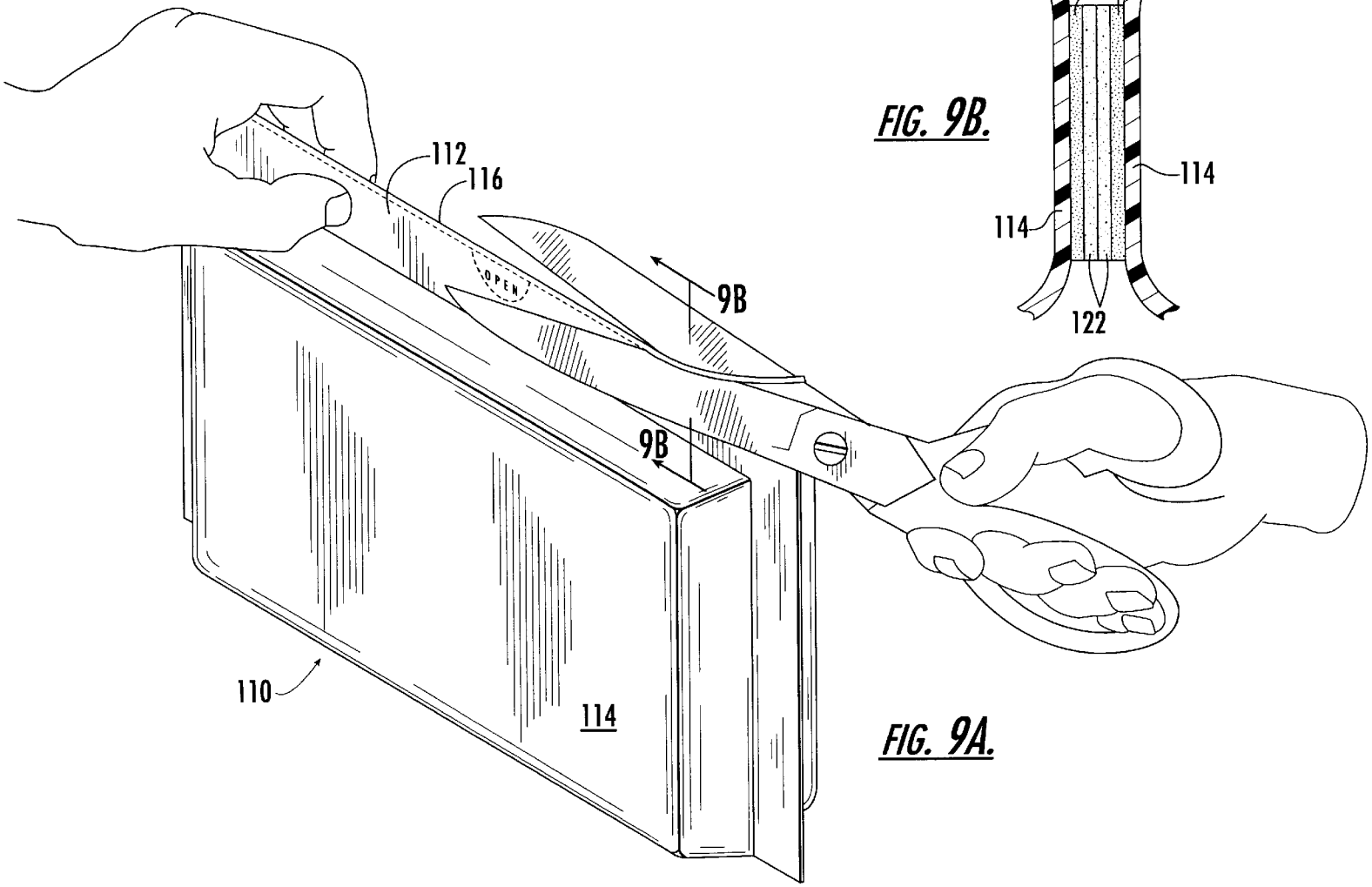

FIG. 9B shows a cross-section through the seal 112 after the fold line 116 has been cut. Each of the opposing portions of the sheet 114 includes a pressure-sensitive adhesive layer 120 adhered to its inner surface and a layer of cohesive 122 covering the pressure-sensitive adhesive layer 120. The seal 112 is formed by sealing the cohesive layers 122 together as shown.

Figures 9C, 9D, 9E, 9F:
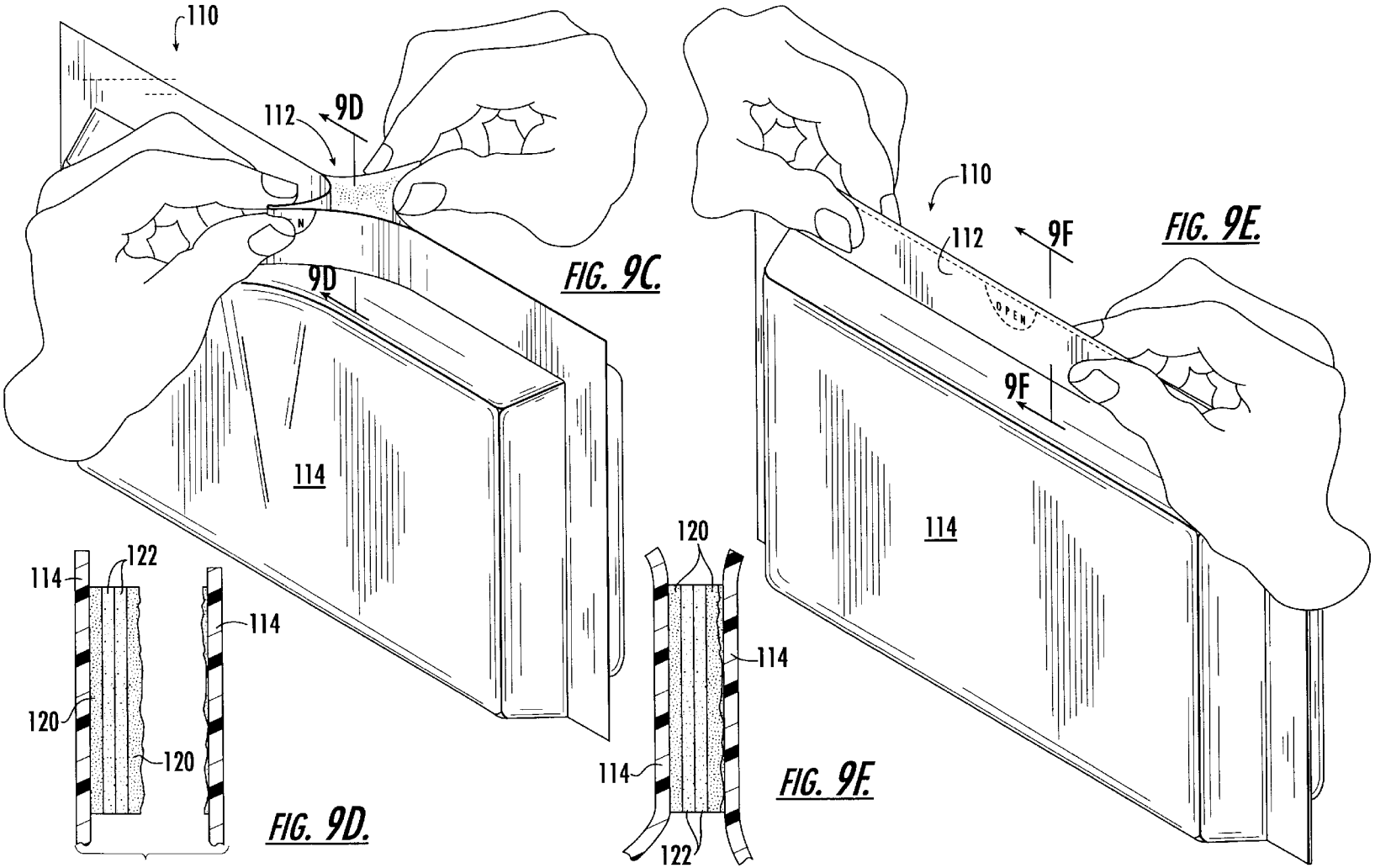

FIGS. 9C and 9D depict the opening of the seal 112 by pulling the opposing portions of the sheet 114 away from each other. Because the pressure-sensitive adhesive 120 has a greater affinity for adhering to the cohesive 122 than to the sheet 114, the pressure-sensitive adhesive 120 is detached from the sheet 114. FIGS. 9E and 9F depict the reclosing of the seal 112 by pressing the opposing portions of the sheet 114 back together such that the detached pressure-sensitive adhesive 120 re-adheres to the sheet 114. The seal 112 may be repeatedly opened and reclosed.

Figure 7:
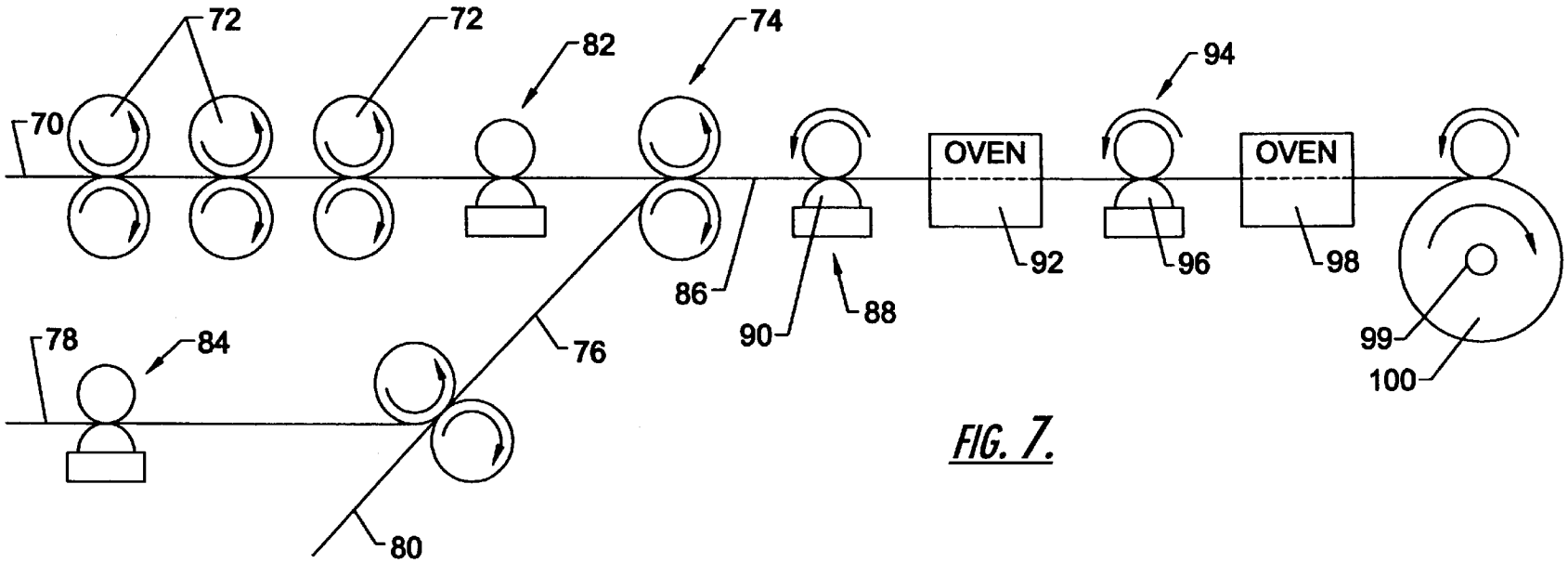
FIG. 7 is a view schematically depicting an apparatus and process for manufacturing a laminated web and applying pressure-sensitive adhesive and cohesive to the web.

In accordance with a preferred embodiment of the invention, the web from which the sheet is taken for forming a package comprises a laminate. As schematically illustrated in FIG. 7, the web advantageously is manufactured in a rotary press having a plurality of stations for performing various printing, laminating, and adhesive application functions. A first layer 70 which forms the outermost layer of a resulting package is passed through a plurality of printing stations 72 where identifying graphics and/or indicia are printed on the layer. The layer 70 is then passed through a laminating station 74 where it is laminated to a pre-laminate 76 comprising two layers 78 and 80. Adhesive is applied to the outermost layer 70 at an adhesive applicator 82 and the outermost layer 70 is then laminated to the pre-laminate 76. The pre-laminate 76 may be a preformed web which is simply taken off a supply roll; alternatively, and as illustrated in FIG. 7, the pre-laminate 76 may be formed just upstream of the laminating station 74 by applying adhesive to the layer 78 (or to the layer 80) at adhesive applicator 84 and then laminating the two layers 78 and 80 together.

After exiting the laminating station 74, the three-layer laminate 86 passes through a pressure-sensitive adhesive applicator 88 where pressure-sensitive adhesive is applied to the inner (product-facing) surface by a cylinder 90. The cylinder 90 has an etched or machined surface configured to apply the pressure-sensitive adhesive in a desired pattern, such as the pattern shown in FIG. 3. The laminate 86 is then passed through an oven 92 where the pressure-sensitive adhesive is dried. Next, the cohesive is applied at an applicator 94 having an etched or machined cylinder 96. Finally, the laminate is passed through a second oven 98 to dry the cohesive, and the finished web is rolled onto a spool 99 for later use. The resulting roll 100 of web material may subsequently be processed by any suitable packaging machinery for forming packages in accordance with the invention.

According to a preferred embodiment of the invention, the layer 70 (also called the print web) comprises 48-gauge PET. The pre-laminate 76 comprises a 1.0 mil layer 78 of HDPE laminated to a 60-gauge layer 80 of metallized OPP which forms a release layer for the pressure-sensitive adhesive. The HDPE layer 78 provides additional tear strength for the laminate. Metallizing of the OPP release layer 80 provides a moisture-barrier function.

In an alternative embodiment, the HDPE layer 78 is eliminated, and the release layer 80 comprises a 75-gauge layer of metallized OPP. The thicker release layer 80 helps compensate for the tear strength that is lost by omitting the HDPE layer.

From the foregoing description of specific embodiments of the invention, it will be appreciated that the invention provides a unique closure for packaging which combines good original seal strength with reclosure capabilities. Although the invention has been explained by reference to particular embodiments thereof, the invention is not limited to the details of these particular embodiments. Modifications may be made to the illustrative embodiments without departing from the scope of the invention. Accordingly, the scope of the invention is to be determined by reference to the appended claims.

What is claimed is:

1. A resealable package for a product, comprising:

a flexible container formed from a generally rectangular flexible sheet having inner and outer surfaces, two opposite longitudinal edges, and top and bottom transverse edges, the sheet being wrapped to form a generally tubular structure having a portion of the inner surface adjacent one longitudinal edge sealed to a corresponding portion of the inner surface adjacent the other longitudinal edge to define a longitudinal seal, the tubular structure having portions of the inner surface adjacent the bottom edge sealed to other portions of the inner surface adjacent the bottom edge to define a bottom seal, and the container including a top end which defines an opening for removal of the product from the tubular structure, the sheet defining a pair of opposite flexible side walls having opposing inner surfaces, the side walls having edge portions positionable in overlying relation, the edge portions being separable from each other to create said opening in the container; and an openable and resealable seal along the opening, the seal being defined by the edge portions of the side walls placed in confronting relation with each other and adhesively sealed together, a layer of pressure sensitive adhesive being applied to the inner surface of at least one of the edge portions, and a layer of cohesive being applied to the inner surfaces of both edge portions and covering the pressure-sensitive adhesive, the cohesive layers of the edge portions being sealed together to form the resealable seal;

the pressure sensitive adhesive having a greater affinity for adhering to the cohesive than to the inner surface of the package, whereby initial opening of the resealable seal causes regions of the cohesive layers on the two side walls to remain adhered together such that regions of pressure-sensitive adhesive are detached from one side wall and remain with the other side wall, and whereby the top seal may be resealed by pressing the edge portions of the two side walls together to cause the detached regions of pressure-sensitive adhesive to be reattached to the one side wall;

wherein the layer of pressure-sensitive adhesive is applied in a pattern extending transversely along the top edge of the sheet, and wherein a strip of cohesive is applied to a portion of the inner surface which is not covered by the pressure-sensitive adhesive layer and which extends transversely along substantially the entire transverse width of the sheet, whereby the strength of the original top seal is enhanced by the strip of cohesive which adheres to itself upon initial sealing of the top seal.

2. The package of claim 1 wherein the transverse strip of cohesive is disposed between the top edge of the sheet and the layer of pressure-sensitive adhesive such that upon initial sealing of the top seal, the strip of cohesive prevents detachment of the pressure-sensitive adhesive until the top seal is fully opened.

3. The package of claim 2 wherein the strip of cohesive is applied in a discontinuous pattern between the top edge of the sheet and the pressure-sensitive adhesive.

4. The package of claim 2 wherein the strip of cohesive between the top edge of the sheet and the pressure-sensitive adhesive is printed in a screen pattern having a coverage of substantially less than 100 percent so as to reduce legging of the cohesive upon opening of the top seal.

5. The package of claim 4 wherein the coverage of the screen print pattern of cohesive is about 50 percent.

6. The package of claim 1 wherein a portion of the strip of cohesive adjacent the top edge of the sheet is indented away from the top edge so as to define a thumb tab for assisting a consumer in initially opening the top seal.

7. The package of claim 6 wherein the outer surface of the sheet includes indicia cooperating with the thumb tab for instructing the consumer how to properly open the top seal.

* * * * *